US006585788B2

(12) United States Patent
Sugano

(10) Patent No.: US 6,585,788 B2
(45) Date of Patent: Jul. 1, 2003

(54) EXHAUST PARTICULATE REMOVING FILTER OF DIESEL ENGINE

(75) Inventor: Takatoshi Sugano, Sagamihara (JP)

(73) Assignee: Isuzu Motors, Ltd., Tokyo (JP)

( * ) Notice: Subject to any disclaimer, the term of this patent is extended or adjusted under 35 U.S.C. 154(b) by 4 days.

(21) Appl. No.: 09/908,566

(22) Filed: Jul. 20, 2001

(65) Prior Publication Data

US 2002/0014056 A1 Feb. 7, 2002

(30) Foreign Application Priority Data

Jul. 25, 2000 (JP) ..... 2000-224159

(51) Int. Cl.[7] ..... B01D 46/04; B01D 39/20

(52) U.S. Cl. ..... 55/282.3; 55/486; 55/487; 55/488; 55/489; 55/500; 55/501; 55/510; 55/521; 55/523; 55/498; 55/499; 55/DIG. 10; 55/DIG. 30

(58) Field of Search ..... 55/282.2, 282.3, 55/486, 487, 488, 489, 495, 497, 498, 500, 501, 509, 510, 511, 521, 523, 529, DIG. 10, DIG. 30, 499

(56) References Cited

U.S. PATENT DOCUMENTS

| | | | | |
|---|---|---|---|---|
| 4,878,930 A | * | 11/1989 | Manniso et al. | 55/521 |
| 5,171,341 A | * | 12/1992 | Merry | 55/484 |
| 5,298,046 A | * | 3/1994 | Peisert | 55/486 |
| 5,611,831 A | * | 3/1997 | Matsuoka et al. | 55/486 |
| 5,682,740 A | * | 11/1997 | Kawamura | 55/521 |

* cited by examiner

*Primary Examiner*—Duane Smith
*Assistant Examiner*—Jason M. Greene
(74) *Attorney, Agent, or Firm*—Dennison, Schultz & Dougherty

(57) ABSTRACT

The width of at least one felt out of a plurality of felts (22 to 24) is formed of ceramic fibers superposed between two wire nets (26, 27) for a heater is made to be narrower than the width w of the wire nets for heater (26, 27), and the width of other felts (22, 24) is made to be the same as the width w of the wire nets (26, 27) for the heater. A superposed body (28) of the wire nets (26, 27) for a heater and the felts (22 to 24) is bent lengthwise to form a tube (21) having a petal shape in section, and a metal frame (31) is connected to both ends of the tube (21).

3 Claims, 4 Drawing Sheets

EXHAUST PARTICULATE REMOVING FILTER OF DIESEL ENGINE

BACK GROUND OF THE INVENTION

The present invention relates to an exhaust particulate removing filter of a Diesel engine using ceramic fibers.

In the conventional exhaust particulate removing filter of a Diesel engine, two felts formed of ceramic fibers are sandwiched between two wire nets for a heater, which is formed in a shape of bellows, and the resultant article is mounted on a metal frame.

Where a filter having the high collecting efficiency of exhaust particulates is fabricated, it is necessary to make a felt thick. However, in the filter in which the felt is thick, it is difficult to mount it on a metal frame, and it is necessary to change the shape of the metal frame and mounting parts onto the metal frame.

SUMMARY OF THE PRESENT INVENTION

In the light of the aforementioned problem, it is an object of the present invention to provide an exhaust particulate removing filter of a Diesel engine in which even if a felt formed of ceramic fibers is made to be thick, a filter is mounted easily on a metal frame.

For solving the above-describe problem, the present invention provides an exhaust particulate removing filter of a Diesel engine characterized in that the width of at least one felt out of a plurality of felts formed of ceramic fibers superposed between two wire nets for a heater is made to be narrower than the width of said wire nets for heater, the width of other felts is made to be the same as the width of said wire nets for a heater, a superposed body of said wire nets for a heater and said felts is bended lengthwise to form a tube having a petal shape in section, and a metal frame is connected to the outer peripheral side of both ends of said tube.

In the exhaust particulate removing filter (hereinafter merely referred to as a filter) according to the present invention, a superposed body of two inner and outer wire nets for a heater over a plurality of felts formed of ceramic fibers is formed into a tube in the form of a bellows or a petal in section. Where a filter of which collecting efficiency is high, a single thick felt is not used but use is made of one in which a plurality of thin felts different in roughness of the meshes are superposed, only one or two felts are made to have the same width as the metal wire nets for a heater, and the remaining felts are made to be narrow in width so as not to come in contact with the wire net for a heater. In a filter comprising a tube formed from the wire nets for a heater and the felts, the thickness of both ends is thinner than the thickness of a central part, and even if the shape of the metal frame and the mounting parts onto the meal frame is not changed, mounting onto the metal frame is easy.

These and other objects and features of the invention will become more apparent upon a perusal of the following description taken in conjunction with the accompanying drawings wherein:

DESCRIPTION OF THE PREFERRED EMBODIMENTS

Figure 1:
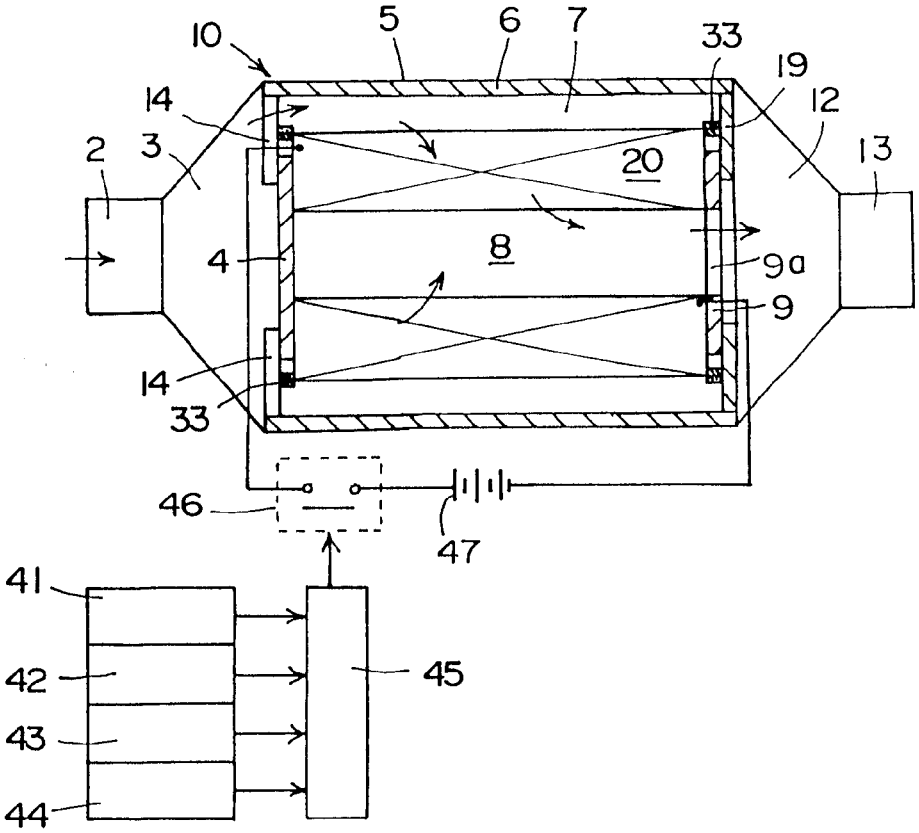
FIG. 1 is a side sectional view of an exhaust purifying device of a Diesel engine provided with an exhaust particulate removing filter according to the present invention.

As shown in FIG. 1, in an exhaust purifying device 10, a filter 20 is disposed within a cylindrical case 5 lined a heat insulating material 6, a conical tube 3 and an inlet pipe 2 are connected to starting end of the case 5, and conical tube 12 and an outlet pipe 13 are connected to terminal end of the case 5, the inlet pipe 2 and the outlet pipe 13 being connected in the middle part of an exhaust pipe. A petal type end wall plate 4 is connected to an inner peripheral side at the starting end of the filter 20 to close the interior of the filter 20. The end wall plate 4 is supported by a plurality of arms 14 extending diametrically inward from the inner peripheral wall of the case 5. On the other hand, a petal type end wall plate 9 having an opening 9*a* in the center thereof is connected to an inner peripheral side at the terminal end of the filter 20, and the end wall plate 9 is supported on the terminal end of the case 5 by an annular plate 19.

When exhaust introduced from the inlet pipe 2 flows to a hollow part 8 via the filter 20 from an outer peripheral hollow part 7 of the filter 20, the exhaust particulates are removed, and the purified exhaust is discharged to outside via the opening 9*a* and the outlet pipe 13. A metal wire net 26 (see FIG. 6) for a heater of the filter 20 is suitably energized via a relay switch 46 from a power supply battery 47 to heat and burn the exhaust particulates removed by the filter 20. When the filter 20 is regenerated, the relay switch 46 is closed by output of an electronic control device 45 on the basis of signals of a sensor for r.p.m. of the engine 41, a sensor for the load of the engine 42, a pressure sensor for exhaust 43 disposed at an inlet part of the filter 20, for example, internally of the conical tube 3, and a temperature sensor 44 disposed on the filter 20. The wire nets 26, 27 for a heater are superposed on both inner and outer surface of the felts.

Figure 2:
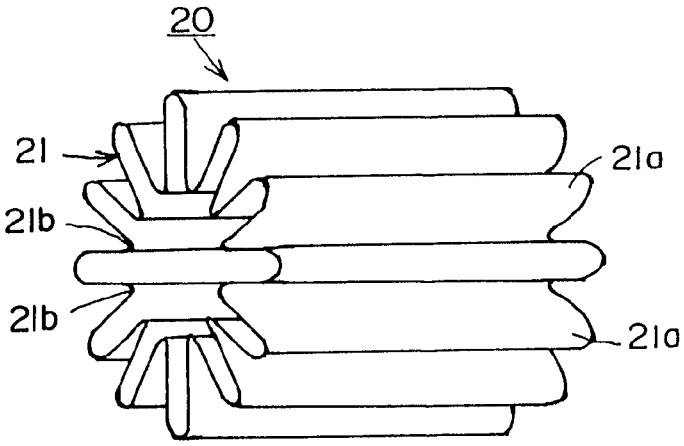
FIG. 2 is a perspective view showing a schematic constitution of the exhaust particulate filter.
Figure 3:
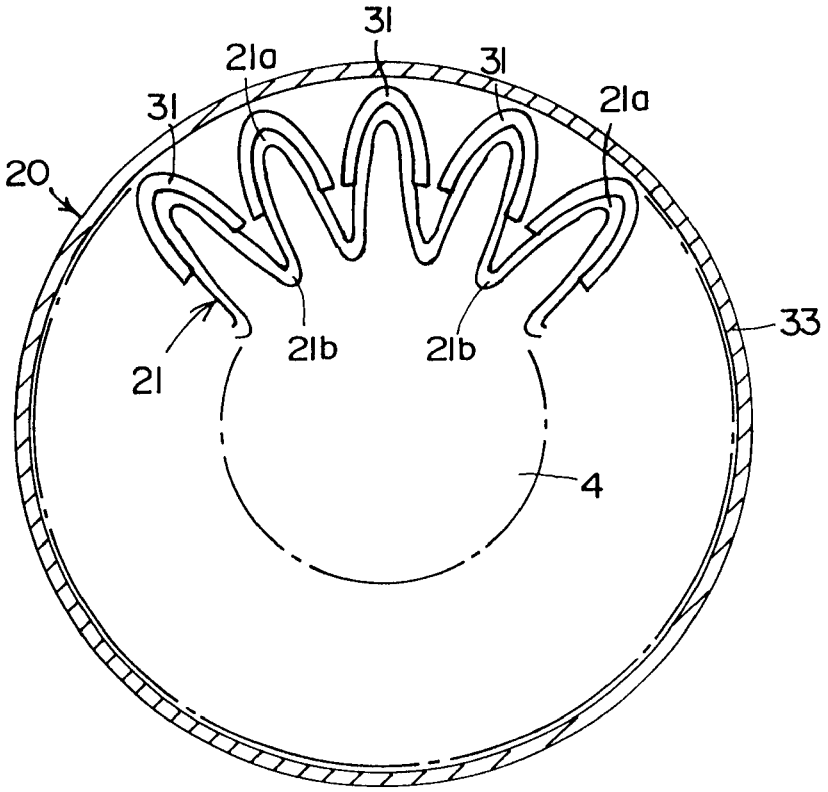
FIG. 3 is a front sectional view showing an end part of the exhaust particulate filter.
Figure 4:
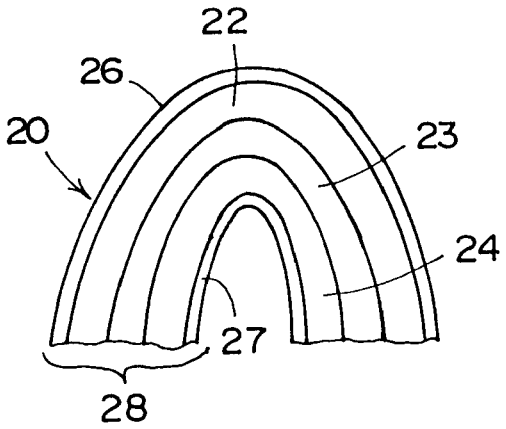
FIG. 4 is a front sectional view showing a central part of the exhaust particulate filter in a large scale.

As shown in FIG. 2, the filter 20 comprises a tube 21 in which a superposed body 28 of an elongated web-like wire net for a heater and a felt formed of ceramic fibers is bended or formed into a petal section. The tube 21 is peripherally alternately provided with a projection 21*a* projecting outwardly and radially and a groove 21*b* projecting inwardly and radially. As shown in FIG. 3, a metal frame 31 bended into a U-shape is superposed on and connected to the outer surfaces of both ends of the projection 21*a* to hold a fixed shape. As a section of an axial central part of the projection 21*a* is shown in an enlarged scale in FIG. 4, in the filter 20, a plurality (three in the illustrated embodiment) of elongated felts 22, 23, 24 are superposed, wire nets 26, 27 for a heater are superposed on the outer surface and the inner surface, and a superposed body 28 is formed or molded into a tube 21 having a petal shape in section.

Figure 5:
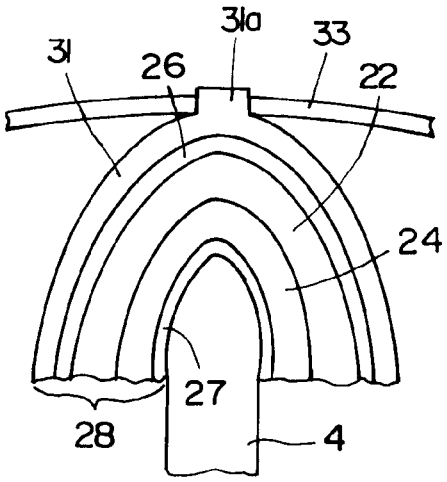
FIG. 5 is a front sectional view showing both end parts of the exhaust particulate filter in a large scale.
Figure 6:
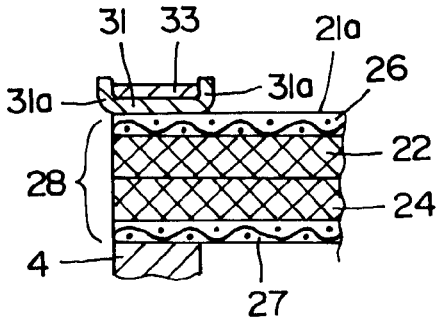
FIG. 6 is a side sectional view showing an end part of the exhaust particulate filter in a large scale.

As shown in FIGS. 5 and 6, according to the present invention, the thickness of both ends of the superposed body 28 is reduced, as described later, by narrowing the width (axial dimension of the tube 21) of at least one (23 in the Figure) out of the felts 22 to 24, sandwiching two felts 22, 24 between the wire nets 26, 27 for a heater on both ends, forming the superposed body 28 into the tube 21 having a petal shape in section, placing both the ends into engagement with the petal shaped end wall plates 4, 9, superposing the metal frame 31 on the outer surfaces of both the ends of the projection 21*a*, and pressing the projection 21*a* against the end wall plates 4, 9 by an annular band 33 engaged between a pair of projections 31*a* of the metal frame 31.

Figure 7:
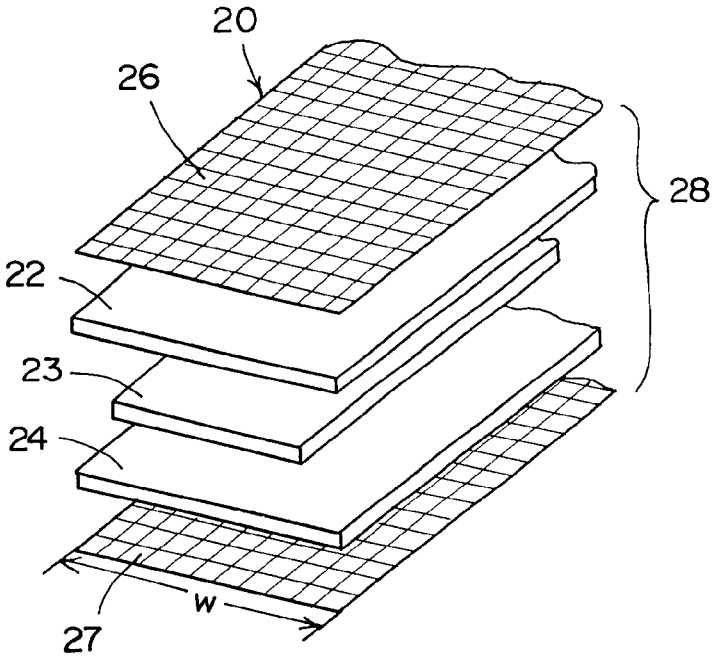
FIG. 7 is a perspective view showing a relationship between meatl wire nets for a heater and a felt formed of ceramic fibers in the exhaust particulate filter.

As shown in FIG. 7, where the filter 20 comprises three felts 22 to 24, the width of the intermediary felt 23 is made to be narrower than the width w of the wire nets 26, 27 for a heater, and the width of the felts 22, 24 is made to be equal to the width w of the wire nets 26, 27 for a heater. By doing so, when the superposed body 28 comprising the wire nets 26, 27 for a heater and the felts 22 to 24 is formed into the tube 21 having a petal shape in section, at both the ends of the tube 21, the felts 22, 24 are merely superposed between the wire nets 26, 27 for a heater, whereby the thickness of both the ends of the tube 21 becomes thinner than that of the central part of the tube 21. Accordingly, even if the shape of the metal frame 31 is not changed, the filter 20 superposed suitable numbers of felts can be constituted. Out of the felts 22 to 24 formed of ceramic fibers, the outer (upper in the figure) felt 22 is roughest in the meshes, and use is made of the intermediary felt 23 and the inner felt 24 which are finer in the meshes in said order.

Figure 8:
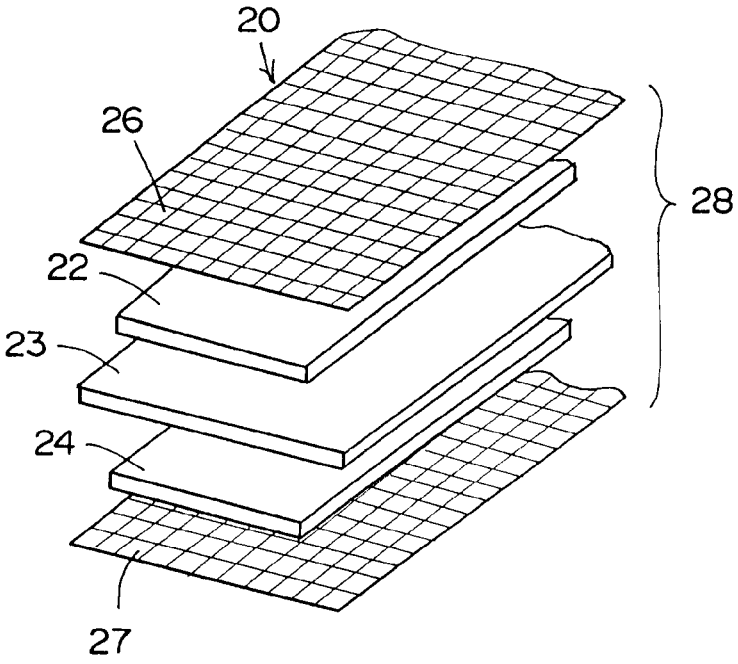
FIG. 8 is a perspective view showing a relationship between meatl wire nets for a heater and a felt formed of ceramic fiber in the exhaust particulate filters.

In the embodiment shown in FIG. 8, where the felts 22, 24 sandwiched between the wire nets 26, 27 for a heater are narrower in width w of the wire nets 26, 27 for a heater, and the intermediary felt 23 is the same in width w as the wire nets 26, 27 for a heater, when the superposed body 28 is formed into the tube 21 having a petal shape in section, the thickness of both the ends is thinner than that of the intermediary part.

Figure 9:
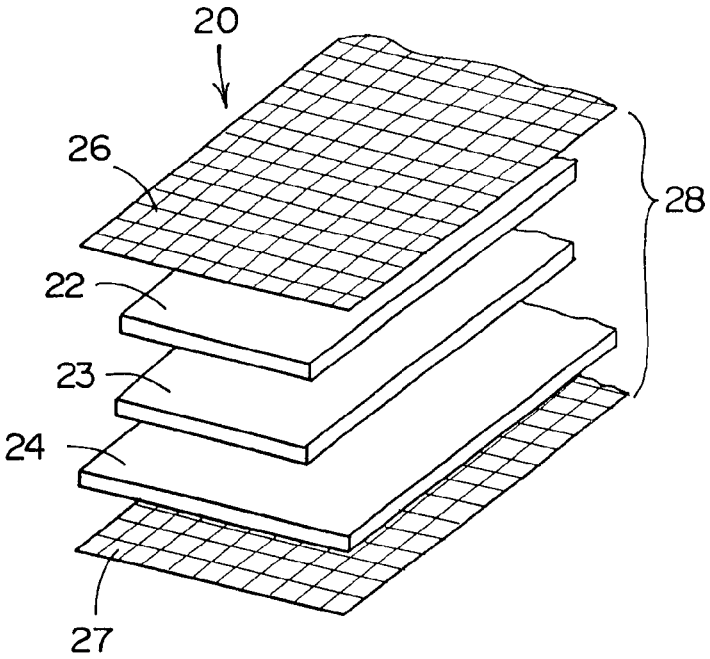
FIG. 9 is a perspective view showing a relationship between meatl wire nets for a heater and a felt formed of ceramic fibers in the exhaust particulate filter.

As shown in FIG. 9, even if the width of the felts 22, 23 out of the felts 22 to 24 is made to be narrower than the width w of the wire nets 26, 27 for a heater, when the superposed body 28 is formed into the tube 21 having a petal shape in section, the thickness of both the ends is thinner than that shown in FIG. 7.

While in the aforementioned embodiment, three felts 22 to 24 are superposed between two wire nets 26, 27 for a heater, it is noted that four or five further thinner felts can be superposed. In that case, if the thickness of suitable two or three felts is made to be narrower than the width w of the wire nets 26, 27 for a heater, when the superposed body 28 is formed into the tube 21 having a petal shape in section, the thickness of both the ends is thinner than that of the central part, so that the sectional shape of the tube 21 can be held using the common metal frame 31 and the band 33, enabling smooth receiving into the cylindrical case 5.

As described above, according to the present invention, the width of at least one felt out of a plurality of felts formed of ceramic fibers superposed between two wire nets for a heater is made to be narrower than the width of said wire nets for heater, the width of other felts is made to be the same as the width of said wire nets for a heater, a superposed body of said wire nets for a heater and said felts is bended lengthwise to form a tube having a petal shape in section, and a metal frame is connected to the outer peripheral side of both ends of said tube. Therefore, it is possible to obtain a filter having the high collecting efficiency of the exhaust particulates without changing the constitution of the metal frame and the shape of mounting parts onto the metal frame.

By making the width of some felts narrow, it is possible to reduce the quantity of ceramic fibers used and reduce the unit price of products.

What is claimed is:

1. An exhaust particulate removing filter for a diesel engine comprising two wire nets for a heater and a plurality of ceramic fiber felts superposed between said two wire nets and characterized by the width of at least one of said plurality of felts formed of ceramic fibers is superposed between said two wire nets for a heater is narrower than the width of said wire nets for the heater, and the width of the other felts of said plurality of ceramic fiber felts is the same as the width of said wire nets for the heater, the superposed body of said wire nets for the heater and said felts being bent lengthwise to form a tube having a petal shape in section, and a metal frame connected to the outer peripheral side of both ends of said tube.

2. The exhaust particulate removing filter for a diesel engine according to claim 1, wherein said plurality of felts, one on an internal side of said tube has a finer mesh then the one on an external side of said tube.

3. The exhaust particulate removing filter for a diesel engine according to claim 1, wherein said metal frame is formed from a metal plate bent into a U shape, and is superposed to both ends of a projection projecting outwardly and radially of said tube.

* * * * *